US007510010B2

(12) United States Patent
Williamson

(10) Patent No.: US 7,510,010 B2
(45) Date of Patent: Mar. 31, 2009

(54) SYSTEM AND METHOD FOR CEMENTING THROUGH A SAFETY VALVE

(75) Inventor: Jimmie R. Williamson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 34 days.

(21) Appl. No.: 11/328,924

(22) Filed: Jan. 10, 2006

(65) Prior Publication Data

US 2007/0158082 A1 Jul. 12, 2007

(51) Int. Cl.
*E21B 34/06* (2006.01)

(52) U.S. Cl. ..... 166/323; 166/386; 166/332.8; 137/527

(58) Field of Classification Search ..... 166/373, 166/332.8, 386, 332.1, 332.4, 323; 137/382, 137/517, 521, 527
See application file for complete search history.

(56) References Cited

U.S. PATENT DOCUMENTS 3,786,865 A 1/1974 Tausch et al.
4,411,316 A 10/1983 Carmody
4,624,315 A * 11/1986 Dickson et al. ..... 166/323
4,651,827 A * 3/1987 Helderle et al. ..... 166/317
6,283,477 B1 * 9/2001 Beall et al. ..... 277/314
6,296,061 B1 * 10/2001 Leismer ..... 166/386
6,575,249 B2 * 6/2003 Deaton ..... 166/373
2004/0154803 A1 8/2004 Anderson et al.
2005/0061519 A1 3/2005 Wagner et al.

OTHER PUBLICATIONS

Search Report for application GB 0700017.7.

* cited by examiner

*Primary Examiner*—Jennifer H Gay
*Assistant Examiner*—Daniel P Stephenson
(74) *Attorney, Agent, or Firm*—Marlin R. Smith

(57) ABSTRACT

System and method for cementing through a safety valve. A system includes a flow passage, closure mechanism, opening prong repeatedly displaceable to thereby repeatedly operate the closure mechanism open and closed, and a latching device initially maintaining the opening prong positioned isolating the closure mechanism from the flow passage, and releasing the latching device permits the opening prong to open and close the closure mechanism while it is exposed to the flow passage. A method includes the steps of: latching an opening prong so that a closure mechanism is open and is isolated from a flow passage; releasing the opening prong so that the closure mechanism is closed and is exposed to the flow passage; and displacing the opening prong to a position in which the closure mechanism is open and is exposed to the flow passage.

20 Claims, 4 Drawing Sheets

SYSTEM AND METHOD FOR CEMENTING THROUGH A SAFETY VALVE

BACKGROUND

The present invention relates generally to equipment utilized and operations performed in conjunction with a subterranean well and, in an embodiment described herein, more particularly provides a system and method for cementing through a safety valve.

It is sometimes desirable to be able to flow cement through a tubing retrievable safety valve. In these circumstances it is unfortunately quite likely that cement will contact a closure mechanism of the safety valve and will subsequently prevent proper operation of the closure mechanism.

In some prior safety valves, the closure mechanism can be isolated from an internal flow passage of the safety valve. However, typically these safety valves require that pressure be applied to a control line connected to the safety valve to maintain the isolation of the closure mechanism, and/or an unreliable metal-to-metal seal is used to achieve the isolation.

It will be appreciated that improvements are needed in the art of safety valves for use in cementing operations.

It is an object of the present invention to provide such improvements. Other objects, benefits and unique aspects of the invention are described below.

SUMMARY

In carrying out the principles of the present invention, a safety valve system and associated method are provided which solve at least one problem in the art. One example is described below in which a safety valve includes a unique latching device for isolating a closure mechanism during cementing operations. Another example is described below in which the latching device is pressure operated to release an opening prong for operating the closure mechanism between open and closed positions.

In one aspect of the invention, a safety valve system is provided which includes a flow passage, a closure mechanism and an opening prong which is repeatedly displaceable to thereby repeatedly operate the closure mechanism between open and closed positions. A latching device initially maintains the opening prong in a position in which the opening prong isolates the closure mechanism from the flow passage. When the latching device is subsequently released the opening prong is permitted to displace to another position in which the closure mechanism is exposed to the flow passage.

In another aspect of the invention, a method of operating a safety valve is provided. The method includes the steps of:

1) latching an opening prong of the safety valve in a first position in which a closure mechanism is in an open position and the closure mechanism is isolated from a flow passage extending through the safety valve;

2) releasing the opening prong and thereby permitting the opening prong to displace to a second position in which the closure mechanism is in a closed position and the closure mechanism is exposed to the flow passage; and 3) displacing the opening prong to a third position in which the closure mechanism is in the open position and the closure mechanism is exposed to the flow passage.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower"; etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
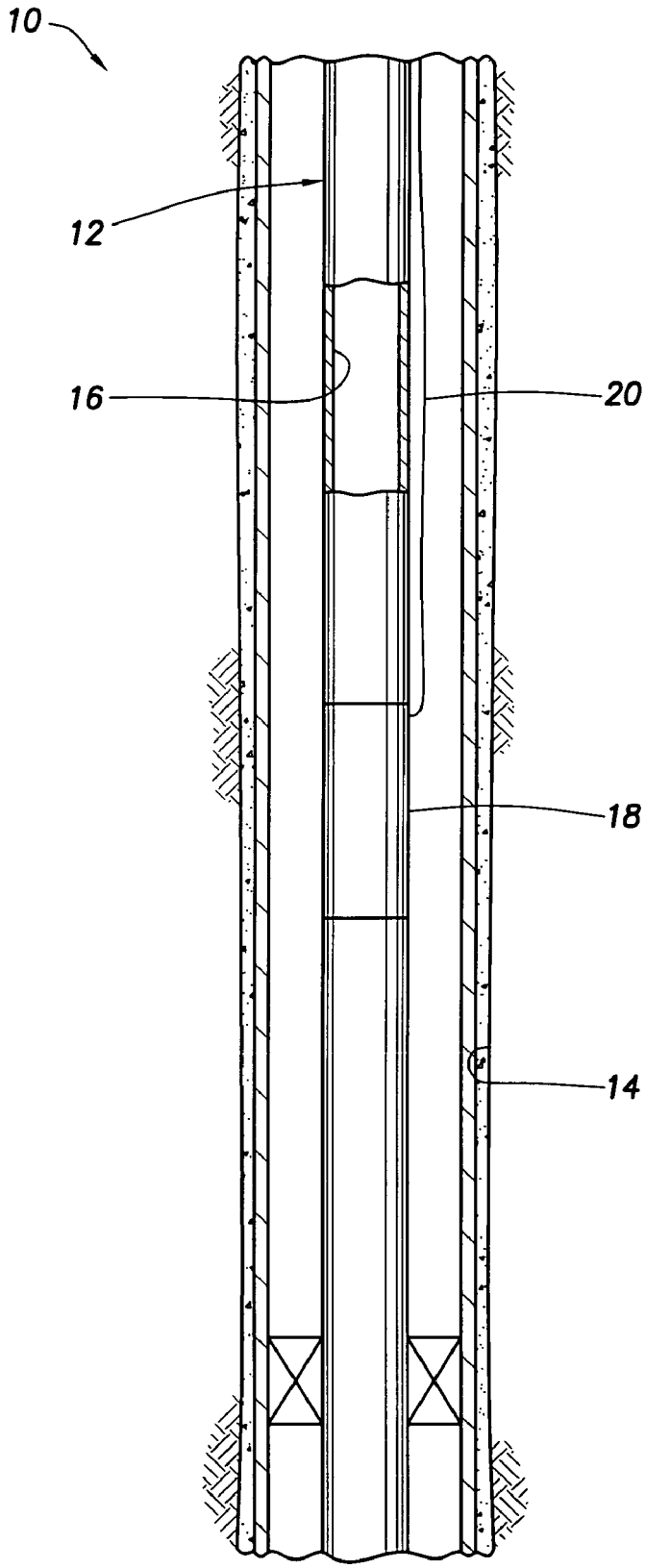
FIG. 1 is a schematic partially cross-sectional side view of a safety valve system embodying principles of the present invention.

Representatively illustrated in FIG. 1 is a safety valve system 10 which embodies principles of the present invention. A tubular string 12 (such as a production tubing string) is installed in a wellbore 14. A flow passage 16 extends through the tubular string 12, for example, to produce fluids to the surface from a subterranean reservoir.

A safety valve 18 is interconnected as part of the tubular string 12. The safety valve 18 is used to shut off flow through the passage 16 in emergency situations, such as to prevent uncontrolled discharge of fluids from the passage.

A line 20 may be connected to the safety valve 18 in order to permit operation of the safety valve from a remote location, such as the earth's surface or another location in the well. In the system 10, the line 20 is a hydraulic control line, but in other embodiments the line could be an electrical line, a fiber optic line, or any other type of line. Furthermore, it is not necessary for a safety valve to be operated using any type of line at all in keeping with the principles of the invention.

At this point it should be noted that the invention is not limited to the specific details of the system 10 described herein. Many other types of systems and methods can be used, without departing from the principles of the invention.

Figure 2:
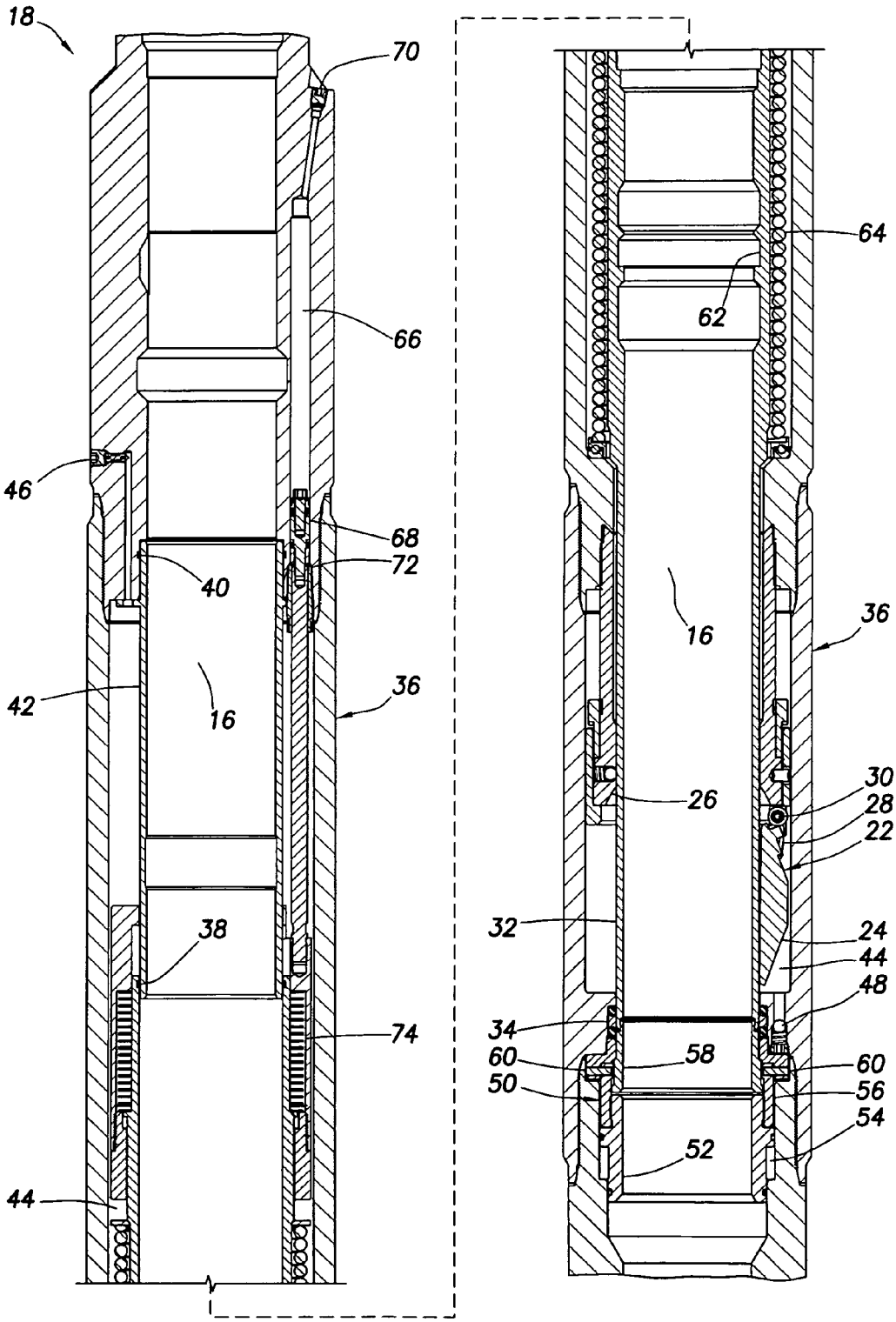
FIG. 2 is a cross-sectional view of a safety valve which may be used in the system of FIG. 1, the safety valve being depicted in an initial run-in and cementing configuration.

Referring additionally now to FIG. 2, the safety valve 18 is representatively illustrated in an enlarged scale cross-sectional view. In this view it may be seen that the safety valve 18 includes unique features which make it particularly suitable for use in situations where it is desired to flow cement through the flow passage 16 of the tubular string 12 in completion operations.

The flow passage 16 extends longitudinally through the safety valve 18. A closure mechanism 22 is used to selectively permit and prevent flow through the passage 16. The closure mechanism 22 includes a flapper 24, seat 26, spring 28 and pivot 30.

As depicted in FIG. 2, the closure mechanism 22 is in an open position in which flow through the passage 16 is permitted. In a closed position of the closure mechanism 22, the spring 28 biases the flapper 24 to pivot upwardly about the pivot 30 and thereby sealingly engage the seat 26 and prevent flow through the passage 16.

A tubular opening prong 32 holds the flapper 24 pivoted downward as shown in FIG. 2 while the tubular string 12 is installed in the wellbore 14. "Opening prong" is a term used in the safety valve art to describe a member which is displaced to cause operation of a closure assembly between its open and closed positions. Opening prongs are also sometimes referred to as flow tubes or operating mandrels, etc.

In one unique feature of the safety valve 18, a seal 34 seals between a lower end of the opening prong 32 and an outer housing assembly 36, so that the closure assembly 22 is isolated from the flow passage 16. The seal 34 and additional seals 38, 40, along with the opening prong 32 and a tubular mandrel 42 isolate a fluid chamber 44 from the flow passage 16.

Prior to interconnecting the safety valve 18 in the tubular string 12 and installing it in the well, the fluid chamber 44 is filled with a fluid, such as water, salt water, water with cement inhibitor, hydraulic fluid, etc. The fluid is introduced into the fluid chamber 44 via a fill port 46.

In order to allow air to escape from the chamber 44 when it is filled, the chamber is equipped with a relief valve 48. Although the relief valve 48 is shown in FIG. 2 as being at a lower end of the chamber 44, the safety valve 18 would preferably be turned upside down during filling of the chamber so that the relief valve is positioned at an upper end of the chamber to thereby allow air in the chamber to escape when it is filled with fluid.

Preferably, some fluid is also allowed to escape through the relief valve 48 when the chamber 44 is filled, to ensure that the air is purged from the chamber. Other techniques, such as evacuating air from the chamber using a vacuum, etc., may be used in keeping with the principles of the invention.

The relief valve 48 opens when a predetermined pressure is reached in the chamber 44. This not only allows air to escape when the chamber 44 is filled with fluid, but also allows the fluid to escape in order to prevent over-pressuring the chamber, for example, due to expansion of the fluid when the fluid is heated after the tubular string 12 is installed in the well.

A latching device 50 maintains the opening prong 32 in the position depicted in FIG. 2 while the safety valve 18 is interconnected in the tubular string 12, while the tubular string is installed in the well, and while cement is flowed through the flow passage 16. In another unique feature of the safety valve 18, this is accomplished without a need to apply pressure to the line 20 connected to the safety valve.

The latching device 50 includes a piston 52 which is biased to displace in response to a pressure differential between the flow passage 16 and an atmospheric or gas chamber 54. The piston 52 is threaded to an outer sleeve 56, and a lower end of an inner sleeve 58 is retained between the piston and the outer sleeve.

Shear pins 60 retain the outer sleeve 56, piston 52 and inner sleeve 58 in the position depicted in FIG. 2. In this position, an upper end of the inner sleeve 58 is received within a lower end of the opening prong 32.

Preferably, an interference fit or press fit exists between the opening prong 32 and the inner sleeve 58. For example, at least a portion of an inner diameter of the lower end of the opening prong 32 may be smaller than at least a portion of an outer diameter of the upper end of the inner sleeve 58 prior to these elements being pressed together so that the outer diameter is received in the inner diameter.

To press the upper end of the inner sleeve 58 into the lower end of the opening prong 32, a special assembly tool may be used to apply a downwardly directed force to the opening prong via a latching profile 62 formed in the opening prong. Once the interference fit between the opening prong 32 and the inner sleeve 58 is achieved, the opening prong will be maintained in its downwardly disposed latched position as depicted in FIG. 2, even though a spring 64 biases the opening prong in an upward direction.

Note that, in its latched position the opening prong 32 is also maintained in sealing engagement with the seal 34, and the chamber 44 is isolated from the flow passage 16. Thus, the chamber 44 can be filled with fluid after the opening prong 32 is maintained in its latched position due to the interference fit between the opening prong and the inner sleeve 58 of the latching device 50.

To release the latching device 50 and permit upward displacement of the opening prong 32, increased pressure is applied to the flow passage 16 (for example, at the end of the cementing operation), thereby causing an increased pressure differential from the flow passage to the gas chamber 54. This increased pressure differential causes the shear pins 60 to shear, allowing the piston 52, outer sleeve 56 and inner sleeve 58 to displace downward, thereby withdrawing the upper end of the inner sleeve from within the lower end of the opening prong 32 and releasing the latching device 50.

Of course, other types of latching devices could be used in place of the latching device 50 in keeping with the principles of the invention. Latching devices including elements such as spring biased lugs or dogs, C-rings, etc., could be used to releasably maintain the opening prong 32 in its downwardly disposed latched position during installation and cementing operations, and then to release the opening prong for upward displacement once the cementing operation has been completed.

Figure 3:
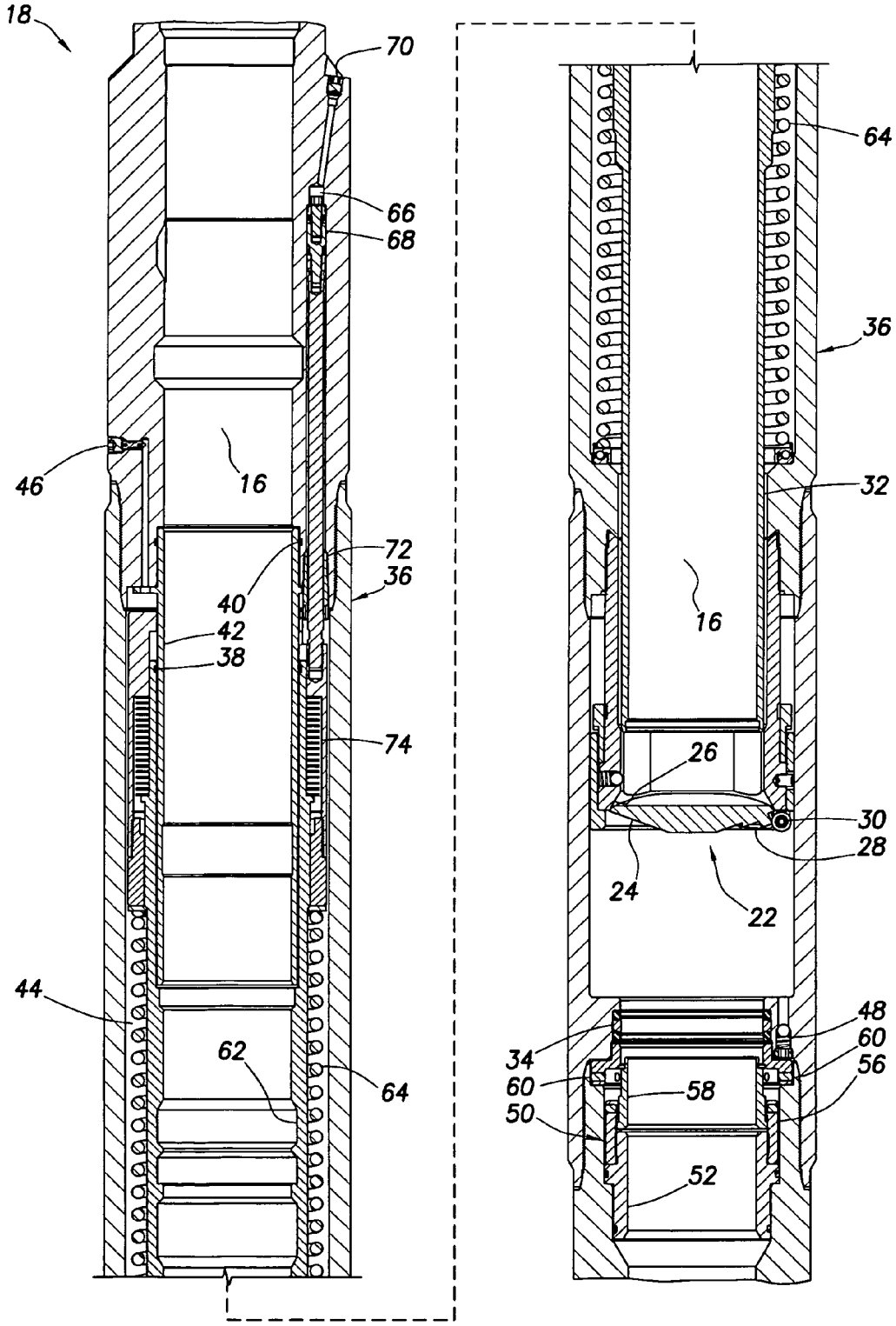
FIG. 3 is a cross-sectional view of the safety valve in a closed configuration.

Referring additionally now to FIG. 3, the safety valve 18 is representatively illustrated after the latching device 50 has been released. Note that the piston 52, outer sleeve 56 and inner sleeve 58 have been downwardly displaced due to the pressure differential between the flow passage 16 and the gas chamber 54, and shearing of the shear pins 60.

The opening prong 32 has been displaced upward by the biasing force exerted by the spring 64 after release of the interference fit between the opening prong and inner sleeve 58. In this upwardly disposed position of the opening prong 32, the closure mechanism 22 is closed, with the spring 28 pivoting the flapper 24 upward to sealingly engage the seat 26.

Figure 4:
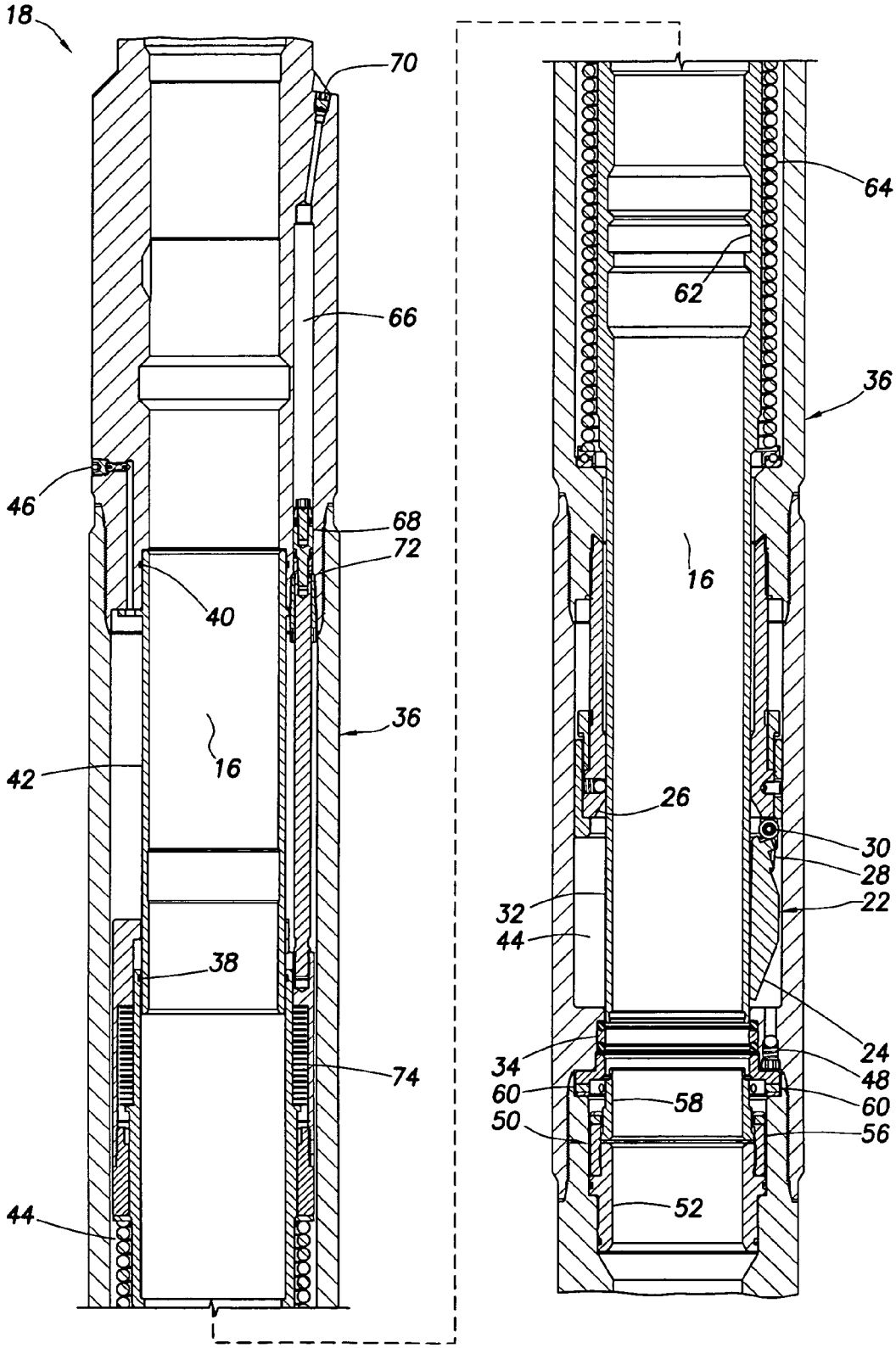
FIG. 4 is a cross-sectional view of the safety valve in an open configuration.

Referring additionally now to FIG. 4, the safety valve 18 is representatively illustrated after increased pressure has been applied to a piston chamber 66 to thereby cause a rod piston 68 to displace downwardly. The piston chamber 66 is in communication with the line 20 via a port 70 when the safety valve 18 is installed as depicted in FIG. 1.

Downward displacement of the piston 68 causes the opening prong 32 to displace downwardly also, thereby opening the closure mechanism 22. Note, however, that the opening prong 32 does not displace downwardly sufficiently far to sealingly engage the seal 34.

Therefore, in this downwardly disposed position of the opening prong 32, the chamber 44 is not isolated from the flow passage 16. A spring-biased slip joint 74 between the opening prong 32 and the piston 68 allows the opening prong to be further downwardly disposed relative to the piston in the FIG. 1 configuration (in which the latching device 50 maintains the opening prong downward in engagement with the seal 34) as compared to the FIG. 4 configuration (in which the latching device is released). This unique feature of the safety valve 18 allows debris (such as sand, etc., which might accumulate in the chamber 44 while the closure mechanism is closed) to escape from the chamber while the closure mechanism is open.

However, the opening prong 32 could displace downwardly sufficiently far to engage the seal 34 and provide isolation between the chamber 44 and the flow passage 16, if desired. For example, downward displacement of the piston 68 is limited by its engagement with a seat 72, but the seat could be positioned lower in the housing assembly 36 to allow the piston to bias the opening prong 32 further downward to engage the seal 34 in other embodiments.

The safety valve 18 can be repeatedly cycled between its closed (FIG. 3) and open (FIG. 4) configurations as many times as desired by varying pressure in the line 20. Increased pressure is applied to the line 20 to open the closure mechanism 22, and pressure in the line is decreased to close the closure mechanism. Thus, after the cementing operation, and after the latching device 50 is released, the safety valve 18 operates similar to a conventional hydraulically operated safety valve.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A safety valve system, comprising:

a flow passage;

a closure mechanism;

an opening prong which is repeatedly displaceable to thereby repeatedly operate the closure mechanism between corresponding open and closed positions; and a latching device which initially maintains the opening prong in a first position in which the opening prong sealingly isolates the closure mechanism from fluid communication with the flow passage, and when the latching device is subsequently released the opening prong is permitted to displace to a second position in which the closure mechanism is exposed to the flow passage.

2. The system of claim 1, wherein the latching device includes an interference fit, the interference fit being eliminated when the latching device is released.

3. The system of claim 1, wherein the opening prong is displaceable to a third position to open the closure mechanism after the latching device is released.

4. The system of claim 3, wherein the closure mechanism is exposed to the flow passage when the opening prong is in the third position.

5. The system of claim 1, wherein the closure mechanism is in a fluid chamber when the opening prong is in the first position.

6. The system of claim 1, wherein the latching device maintains the opening prong in the first position isolating the closure mechanism from the flow passage without application of pressure to a line.

7. The system of claim 6, wherein the opening prong is permitted to cycle repeatedly between the second position and a third position in which the closure mechanism is operated to the open position, in response to varying pressure in the line, and after the latching device is released.

8. A safety valve system, comprising:

a flow passage;

a closure mechanism;

an opening prong which is repeatedly displaceable to thereby repeatedly operate the closure mechanism between corresponding open and closed positions; and a latching device which initially maintains the opening prong in a first position in which the opening prong isolates the closure mechanism from the flow passage, and when the latching device is subsequently released the opening prong is permitted to displace to a second position in which the closure mechanism is exposed to the flow passage, wherein the latching device is released in response to pressure applied to the flow passage.

9. A safety valve system, comprising:

a flow passage;

a closure mechanism;

an opening prong which is repeatedly displaceable to thereby repeatedly operate the closure mechanism between corresponding open and closed positions; and a latching device which initially maintains the opening prong in a first position in which the opening prong isolates the closure mechanism from the flow passage, and when the latching device is subsequently released the opening prong is permitted to displace to a second position in which the closure mechanism is exposed to the flow passage, wherein the latching device is released in response to a pressure differential between the flow passage and an internal gas chamber.

10. A safety valve system, comprising:

a flow passage;

a closure mechanism;

an opening prong which is repeatedly displaceable to thereby repeatedly operate the closure mechanism between corresponding open and closed positions;

a latching device which initially maintains the opening prong in a first position in which the opening prong isolates the closure mechanism from the flow passage, and when the latching device is subsequently released the opening prong is permitted to displace to a second position in which the closure mechanism is exposed to the flow passage, and wherein the closure mechanism is in a fluid chamber when the opening prong is in the first position; and a pressure relief valve which opens when a predetermined pressure is reached in the fluid chamber.

11. A method of operating a safety valve, the method comprising the steps of:

latching an opening prong of the safety valve in a first position in which a closure mechanism is in an open position and the closure mechanism is sealingly isolated from fluid communication with a flow passage extending through the safety valve;

releasing the opening prong and thereby permitting the opening prong to displace to a second position in which the closure mechanism is in a closed position and the closure mechanism is exposed to the flow passage; and displacing the opening prong to a third position in which the closure mechanism is in the open position and the closure mechanism is exposed to the flow passage.

12. The method of claim 11, further comprising the step of repeatedly cycling the opening prong between the second and third positions.

13. The method of claim 11, wherein the latching step further comprises producing an interference fit, and wherein the releasing step further comprises eliminating the interference fit.

14. The method of claim 11, wherein the releasing step is performed in response to applying pressure to the flow passage.

15. The method of claim 11, further comprising the steps of positioning the closure mechanism in a fluid chamber of the safety valve, and surrounding the closure mechanism with fluid in the fluid chamber.

16. The method of claim 15, further comprising the step of installing a pressure relief valve in the safety valve.

17. The method of claim 16, wherein the pressure relief valve opens when a predetermined pressure is reached in the fluid chamber.

18. The method of claim 11, wherein the latching step further comprises maintaining the opening prong in the first position isolating the closure mechanism from the flow passage without application of pressure to a line connected to the safety valve.

19. The method of claim 18, further comprising the step of repeatedly cycling the opening prong between the second and third positions in response to varying pressure in the line, after the releasing step.

20. A method of operating a safety valve, the method comprising the steps of:

latching an opening prong of the safety valve in a first position in which a closure mechanism is in an open position and the closure mechanism is sealingly isolated from a flow passage extending through the safety valve;

releasing the opening prong and thereby permitting the opening prong to displace to a second position in which the closure mechanism is in a closed position and the closure mechanism is exposed to the flow passage; and displacing the opening prong to a third position in which the closure mechanism is in the open position and the closure mechanism is exposed to the flow passage, wherein the releasing step is performed in response to applying a pressure differential between the flow passage and an internal gas chamber of the safety valve.

* * * * *